United States Patent [19]

Sarka et al.

[11] Patent Number: 4,727,784

[45] Date of Patent: Mar. 1, 1988

[54] WEB CUT BLANK PILING METHOD AND APPARATUS

[75] Inventors: Albert J. Sarka, West Bloomfield; Jerry L. Bell, Pontiac, both of Mich.

[73] Assignee: Bernal Rotary Systems, Inc., Troy, Mich.

[21] Appl. No.: 865,103

[22] Filed: May 20, 1986

[51] Int. Cl.[4] ..... B26D 7/32

[52] U.S. Cl. ..... 83/26; 83/23; 83/88; 271/22

[58] Field of Search ..... 83/88, 23, 26; 271/202

[56] References Cited

U.S. PATENT DOCUMENTS

| | | | |
|---|---|---|---|
| 2,670,955 | 3/1954 | Strecker | 271/202 |
| 2,819,079 | 1/1958 | Beaulieu | 271/202 |
| 3,942,786 | 3/1976 | Lauren | 83/88 X |

FOREIGN PATENT DOCUMENTS

| | | | |
|---|---|---|---|
| 1112446 | 11/1955 | France | 83/88 |
| 2025372 | 1/1980 | United Kingdom | 271/202 |
| 2059392 | 4/1981 | United Kingdom | 271/202 |

*Primary Examiner*—Donald R. Schran

*Attorney, Agent, or Firm*—Barnes, Kisselle, Raisch, Choate, Whittemore & Hulbert

[57] ABSTRACT

A method and apparatus for piling a plurality of cut blanks of a flexible material in overlapped and shingled or stacked relationship. After being cut each blank is accelerated to increase its lineal speed to thereby produce a gap between the blank and an immediately succeeding blank. After acceleration, each blank is deflected, preferably by a plate, away from and out of its accelerated path of travel toward an underlying receiving surface such as a conveyor or platform. After being deflected, the trailing portion of each blank is displaced preferably by rotating cams so that when rapidly decelerated, an immediately succeeding blank passes into and is deposited in overlapping relationship with such blank. To deposit the blanks is stacked relationship with their leading edges substantially aligned, they are decelerated from their forward travel to a complete stop preferably by striking a positive stop. To deposit the blanks in shingled relationship with their leading edges spaced apart, they are rapidly decelerated to a relatively slow speed at which they continue to be advanced in their path of travel, preferably by a conveyor on which they are received.

26 Claims, 13 Drawing Figures

WEB CUT BLANK PILING METHOD AND APPARATUS

FIELD OF THE INVENTION

This invention relates to blanks completely cut from a continuous web of flexible material and more particularly to piling a plurality of such blanks in overlapped and shingled or stacked relationship.

BACKGROUND OF THE INVENTION

Previously, a plurality of blanks have been completely cut or severed from a continuous web of flexible material by rotary dies. To pile a plurality of the cut blanks in overlying and shingled or stacked relationship, as each blank emerges from the cutting dies, it is accelerated to increase its lineal speed along a pre-determined path of travel and thereby produce a gap between its trailing edge and the leading edge of an immediately succeeding cut blank. After acceleration, each blank strikes a deflector plate and is deflected generally away from and out of its predetermined path of travel and toward an underlying receiving surface, such as a conveyor or a platform.

After being deflected, each blank is rapidly decelerated so that an immediately succeeding blank will pass into and be deposited in overlying relationship with such blank so that a plurality of the blanks are deposited on the receiving surface. If the receiving surface is a relatively slowly moving conveyor the blanks are deposited in overlapped and shingled relationship with their leading edges being longitudinally spaced apart. If when decelerated the blanks are completely stopped, they can be deposited on a platform in overlapped and generally vertically stacked relationship with their leading edges substantially aligned with each other.

The known apparatus for shingling and stacking cut blanks performs satisfactorily so long as the blanks emerge from the rotary dies at a relatively slow speed. However, when the cut blanks emerge from the dies at a speed greater than about 300 lineal feet per minute, they jam up in the apparatus and hence cannot be properly and reliably shingled or stacked at substantially higher speeds. This severely limits the output of the cutting dies which can cut blanks at speeds of 1,000 linear feet per minute and in some applications at speeds up to or even in excess of 2,000 linear feet per minute.

SUMMARY OF THE INVENTION

It has been discovered that the jamming of the apparatus is caused by a leading edge of a blank either striking the trailing edge of an immediately preceding deflected blank or contacting and sliding over a sufficient portion of the surface of the preceding deflected blank so that it catches or hangs up on the tabs, cut-outs, slits or the like in the preceding blank. This jamming problem is greatly compounded by the flexibility of the cut blank which permits portions of the blank to bow, warp or flex so that the blank is no longer essentially planer. The blanks are usually extremely flexible both because they are made of relatively thin and flexible material, such as paper, paperboard, plastic films, etc., and because they usually have various creases or fold lines, cut-outs, perforations, slits and the like therein.

This jamming problem is also compounded by the need to rapidly decelerate or completely stop the flexible blank in a short distance so that it will not slide over any substantial length of an underlying blank and hence become caught or hung up on tabs, cut-outs, slits or the like therein. This jamming problem is further compounded by the tendency of the blanks to float on a cushion of air and hence relatively slowly move out of the path of travel of an immediately succeeding blank. The blanks tend to float on an air cushion because they have a relatively large surface area and are lightweight or have a small mass.

In accordance with the method and apparatus of this invention, cut blanks of flexible material can be piled in overlapped and shingled or stacked relationship at speeds greatly in excess of 300 lineal feet per minute by accelerating each blank along a first path to produce a space between its trailing edge and the leading edge of an immediately succeeding blank, deflecting the accelerated blank out of the first path, and then rapidly and positively displacing the trailing portion of each blank so that it will not be struck by or hang up with an immediately succeeding accelerated blank. Preferably, the trailing portion of each blank is rapidly and positively displaced by one or more cams which are rotated in timed relationship with the movement of the blanks so that none of the cams will interfere with the leading edge of the immediately succeeding blank as it passes into overlapped relationship with an underlying blank. Preferably, the cam or other means for rapidly displacing the trailing edge portion of each blank is used in conjunction with a deflector plate or other means for moving the bulk of each blank out of the first path of the accelerated blanks.

Objects, features and advantages of this invention are to provide a method and apparatus for piling in shingled or stacked relationship a plurality of flexible cut blanks which substantially eliminates the jamming of blanks when being piled, will reliably and repeatedly pile cut blanks at high speeds, permits rotary cutting dies to be operated at substantially higher speeds, is relatively simple, efficient, durable, and rugged, and is easily used in and highly suitable for mass production manufacturing operations.

BRIEF DESCRIPTION OF THE DRAWINGS

These and other objects, features and advantages of the invention will be apparent from the following detailed description, appended claims, and accompanying drawings in which:

DETAILED DESCRIPTION

Figure 1:
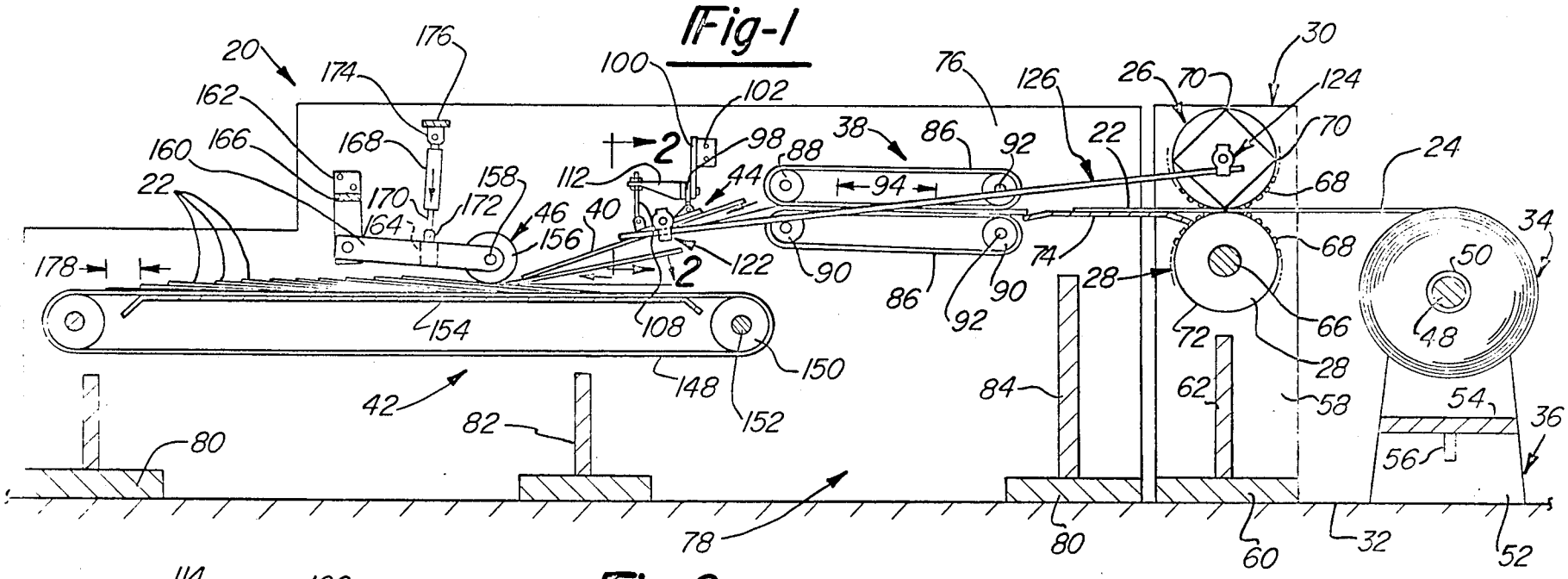
FIG. 1 is a side view with protions broken away and in section of an apparatus embodying this invention for piling a plurality of cut blanks in shingled relationship.

In accordance with the method of this invention, a plurality of blanks are cut from a web of flexible material, preferably by a rotary cutting die, traveling at a relatively high speed and are placed in overlapped and shingled or stacked relationship substantially without jamming or hanging up of the cut blanks. After each blank is cut, it is accelerated along a predetermined first path to an increased lineal speed to provide a gap or space between its trailing edge and the leading edge of an immediately succeeding cut blank. Preferably, each blank is accelerated to a speed about 1.5 to 2 times the speed of the blanks when they exit the cutting die. After acceleration, each blank is deflected away from the first path and toward a carrier such as an underlying conveyor or support surface.

Preferably after the blank has been completely deflected out of its first path, the trailing portion of the blank is rapidly and positively displaced so that it will be clear of and will not interfere with the movement of an immediately succeeding accelerated blank into overlying relationship with such displaced blank. The trailing portion of the blank is rapidly displaced without interfering with the travel of the leading portion of the immediately succeeding blank. Preferably, this is accomplished by a cam or other displacement means projecting across the intended path of travel of the leading edge of the immediately succeeding blank and contacting and positively displacing the trailing portion of the preceding blank and then being retracted to clear the intended path so that the leading portion of the succeeding blank can pass between the cam or other displacement means and the trailing portion of the preceding blank.

Preferably, to minimize the extent to which an accelerated and deflected blank bears on and slides over an underlying preceding blank, it is rapidly decelerated to a linear speed which is less than 1/5 and preferably less than 1/10 of the speed to which the blank was accelerated. If the blanks are to be piled in a shingled relationship, after deceleration each blank is moved at a relatively slow lineal speed, preferably by an underlying conveyor, so that when a plurality of the blanks have been deposited in a pile on the conveyor, they are in a shingled relationship with the leading edge of each blank spaced apart from the leading edge of an immediately underlying blank. Preferably, each blank is rapidly decelerated by its leading edge striking and then passing under a roller or other retarding means as it is advanced by the conveyor to deposit the blanks in shingled relationship.

If a plurality of the blanks are to be piled in stacked relationship, each blank is decelerated to a complete stop at substantially the same point in its path of travel so that a plurality of the blanks are deposited in overlying relationship with their leading edges substantially aligned so that the blanks lie in stacked relationship. Preferably, each blank is rapidly decelerated to a complete stop at the same point in its forward travel by its leading edge striking a positive stop. Preferably the blanks are received on an underlying platform of an elevator which is lowered as the blanks are received thereon so they are stacked in a generally vertical pile.

SHINGLING APPARATUS

A suitable apparatus 20 for piling cut blanks 22 in overlapped and shingled relationship after they have been cut from a continuous web 24 is shown in FIG. 1. The blanks are completely cut from the web by a pair of rotating die cylinders 26 and 28 carried by a die stand 30 mounted on a floor 32. The continuous web is in the form of a roll 34 carried by a reel stand 36 mounted on the floor. Each cut blank passes through an accelerating mechanism 38 and engages a deflector plate 40 which guides the blank generally downwardly toward a conveyor 42. The trailing portion of each blank is displaced by a by cam assembly 44. Each deflected blank is rapidly decelerated by a retarder assembly 46 so that it is deposited on the carrier conveyor 42 in a shingled relationship with its leading edge spaced from the leading edge of an immediately underlying blank.

Preferably, the web 24 is of a relatively thin and flexible material, such as paper, paperboard, plastic, metal foil and the like. Typically, the web has a thickness of about 0.005 to 0.035 of an inch and a width of about six to sixty inches. A blank cut from the web can be of conventional construction and configuration, such as paperboard blanks for making containers for twelve cans of beer, plastic envelopes for enclosing the disk of magnetic media of floppy disks for computers and the like. Usually, these cut blanks have several flaps, tabs, cut-outs, perforation lines, crease lines for folding the blanks and the like.

The reel stand 36 can be conventional and has a shaft 48 on which a spool 50 of the roll is rotatably received. The shaft is supported by a pair of uprights 52 which are fixed in laterally spaced apart and parallel relationship to a cross plate 54 reinforced by gussets 56.

The die stand 30 can be conventional and has a pair of uprights 58 fixed in laterally spaced apart and parallel relationship to a base 60 and a reinforcing cross plate 62. The die cylinders are received on shafts 64 and 66 each journalled in bearings (not shown) carried by the uprights. The die cylinders are rotated in opposite directions and in synchronization through meshed gears 68 fixed to the shafts and are driven by an electric motor (not shown).

In cutting relatively simple rectangular blanks, the dies can be conventional such as the upper die 26 having four equally circumferentially spaced apart cutting edges 70, each extending generally axially across the entire width of the web and co-acting with a plain cylindrical surface 72 on the lower die extending axially across the entire width of the web and providing an anvil underlying and cooperating with the cutting blades to completely sever the web across its entire width to produce a plain rectangular blank. For blanks having more complicated configurations with cut-outs, tabs, slits, folds and the like, preferably the rotary die cylinders have cooperating cutting blades on both cylinders and are of the type disclosed in United States patent application Ser. No. 589,505, filed on Mar. 14, 1984 and issued on Sept. 2, 1986 as U.S. Pat. No. 4608,895. The disclosure of this patent is incorporated herein by reference and hence the construction and arrangement of these rotary dies will not be described in further detail.

As each cut blank emerges from the rotary dies, it slides over a guide plate 74 and into the accelerating assembly. The guide plate is fixed to a pair of uprights 76 of a frame 78 of the apparatus. The uprights are fixed in spaced apart and parallel relationship to base plates 80 and reinforcing cross plates 82 and 84.

The accelerating assembly 38 has a pair of endless belts 86, each received over a pair of spaced apart driving rolls 88 and 90 each fixed to a shaft 92 journalled in bearings (not shown) mounted on the uprights of the frame. Each blank is engaged and advanced with respect to its immediately succeeding blank to produce a gap or space 94 therebetween by the adjacent runs of the belts which are driven in unison at the same surface speed by rotating the rolls associated with each belt in opposite directions in synchronization. To advance each blank with respect to its succeeding blank, the linear surface speed of the belts is greater than the linear speed at which the blanks emerge from the cutting dies. Usually, the linear surface speed of the belts is in the range of about 1.5 to 2.0 times the linear speed at which the blanks emerge from the cutting dies.

Figure 2:
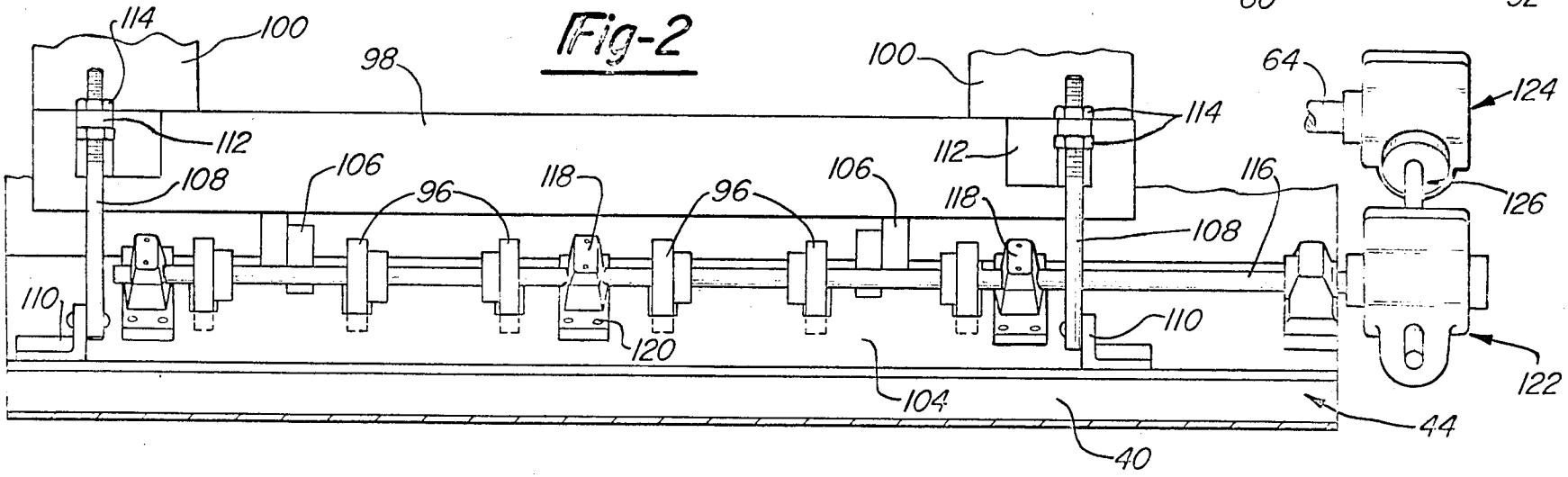
FIG. 2 is a fragmentary view of a cam and deflector plate assembly taken generally on line 2—2 of FIG. 1.
Figure 3:
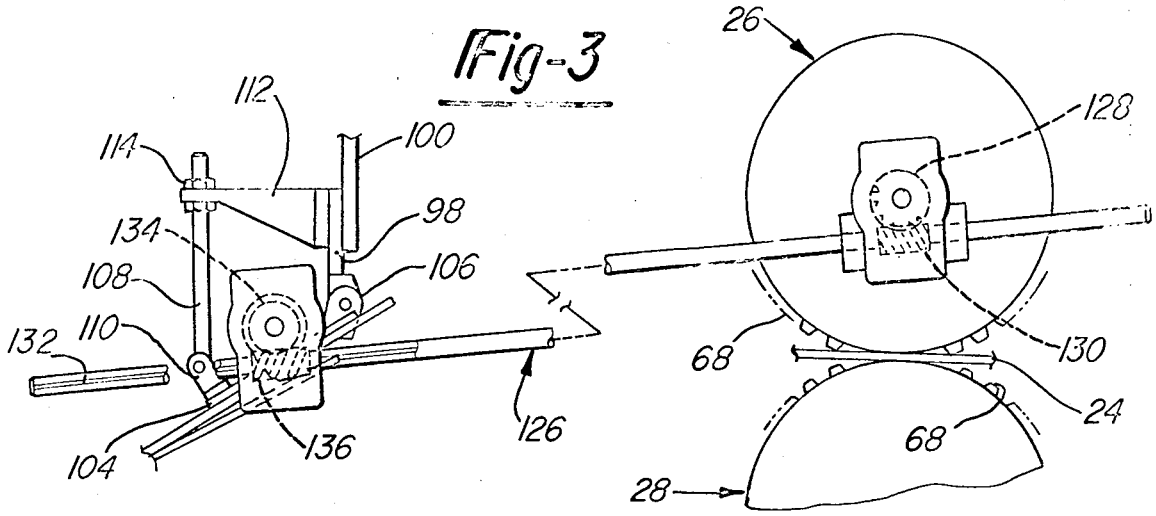
FIG. 3 is a fragmentary side view of the driving mechanism for the cam assembly of the apparatus of FIG. 1.

As the leading edge of each blank emerges from the accelerating mechanism it strikes and slides over the lower face of deflector plate 40 which crosses and is inclined to the path along which the blank was accelerated to direct the blank generally downwardly toward the conveyor 42 as the blank advances along the plate. As the trailing portion of the blank passes under the cam assembly 44, it is displaced downwardly by rotating cams 96 of the assembly. As shown in FIG. 2, the deflector plate and cam assembly are mounted on the frame by a support bar 98 fastened to a pair of brackets 100 secured by cap screws 102 to the uprights. To permit the angle of inclination of the deflector plate 40 to be varied and adjusted, it is secured to a carrier plate 104 pivotally mounted by hinges 106 on the support bar. The angular position of the deflector plate can be adjusted by a pair of rods 108 pivotally connected adjacent one end to anchor brackets 110 fixed to the carrier plate. The other end of each rod is slidably received through a hole in a bracket 112 which is secured at its other end to the support bar. Each rod is releasably retained in the bracket by a pair of jam nuts 114 threaded on the rod which can be adjusted to change the angular position of the deflector plate.

The cams 96 are each mounted on a shaft 116 for rotation therewith which is journalled in bearing blocks 118 secured by cap screws 120 to the carrier plate. The shaft and hence the cams are rotated in timed relationship or synchronization with the cutting dies so that they will contact and displace only the trailing portion of each blank and will clear and not interfere with movement of the leading portion of a succeeding blank along the underface of the deflector plate. This synchronization can be accomplished by driving the cam shaft 116 from one of the rotary dies through a pair of right angle heads 122, 124 and a connecting shaft 126. The head 124 has a worm gear 128 connected to the die shaft 64 and meshing with a worm 130 secured to the connecting shaft. To facilitate removing the apparatus 20 from the die stand, the head 122 is releasably connected to the coupling shaft 126 by mating splines 132 in the shaft and a worm 134 so that the end portion of the shaft can be removably received in and coupled with the worm. A worm gear 136 meshes with the worm 134 and is connected to the cam shaft 116.

Alternately, if desired, the cams can be driven by a separate electric motor which can be a stepper motor so that the phase relationship of the cams to the blanks can be varied and adjusted while the apparatus is operating to fine tune the timing of the rapid displacement of the trailing portion of each blank.

Due to the flexibility of the blanks it is desirable and often necessary to use a plurality of cams 96 spaced apart across the transverse width of the web to ensure its entire trailing portion is displaced sufficiently. Typically one cam is needed for about every 3 to 6 inches of the transverse width of the blank.

Figure 8:
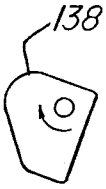
FIGS. 8–11 are side views of various forms of cams which can be utilized in the cam assembly of the apparatus of FIG. 1.
Figure 9:
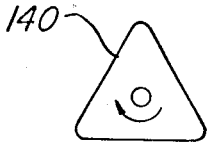
Figure 10:
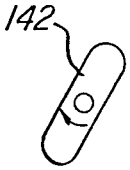
Figure 11:
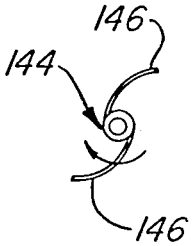

The cams can have a variety of different configurations including, without limitation, those shown in FIGS. 8–11. If desired, the cams can have more than one lobe so they will displace more than one blank for each full revolution of the cams which will enable the cams to be rotated at a slower speed. FIG. 8 illustrates a cam 138 with a configuration which displaces only one blank for each full revolution of the cam. FIG. 9 shows a cam 140 having a generally triangular configuration which displaces three blanks per each full revolution of the cam. FIG. 10 illustrates a cam 142 having an enlongate configuration which displaces two blanks per each full revolution of the cam. FIG. 11 illustrates a cam 144 having two somewhat flexible wipers 146 which displaces two blanks per each full revolution of the cam.

The carrier conveyor 42 has an endless belt 148 received over a pair of drive rolls 150, each secured to a shaft 152 journalled in bearings (not shown) mounted on the uprights of the frame. Preferably, the belt has a transverse width greater than that of the blank. The upper run of the belt is supported by an underlying slide plate 154 secured to the uprights. The rolls are driven by an electric motor (not shown) so that the upper run of the belt travels generally in the same direction as the blanks. In cooperation with the retarding assembly, to provide the shingling of the blanks with their leading edges spaced apart, the linear surface speed of the upper run of the conveyor is much slower than the linear surface speed of the blanks when they emerge from the accelerating mechanism. The linear speed of the conveyor belt is usually less than about 1/5, frequently less than about 1/10 and often about 1/20 to 1/100 of the linear speed of the belts of the accelerating mechanism. The extent of the spacing between the leading edges of immediately adjacent blanks when deposited in the pile can be varied and adjusted by changing the speed of the conveyor belt relative to the speed of the belts of the accelerating mechanism. To facilitate adjusting the speed of the conveyor belt, it is preferably driven by a variable speed electric motor. In some applications, it is desirable to drive both the accelerating mechanism and the conveyor by synchronous motors so that their speed will automatically vary in relation to variations in speed of the cutting dies.

Each blank is rapidly decelerated when its leading edge strikes a roller 156 of the decelerator assembly. Preferably, the roller extends axially across the full width of the blank. Typically, the diameter of the rollers is 5 to 10 inches. The roller is secured to a shaft 158 journalled for rotation by bearings (not shown) mounted on one end of a pair of spaced apart carrier arms 160 each pivotally connected adjacent its other end to a bracket 162 secured to one of the uprights of the frame. The arms are retained in parallel and spaced apart relationship by a strut 164 extending between and fixed to the arms. A reinforcing strut 166 also extends between and is fixed to the brackets.

The force with which the roller bears on the pile of blanks can be adjusted and varied within predetermined limits by a ram 168. The piston rod 170 of the ram is pivotally connected to a clevis 172 fixed to the strut 164 interconnecting the arms and its casing end block is pivotally connected to a clevis 174 fixed to a strut 176 extending between and fixed to the uprights of the frame. Usually, the force applied by the retarder assembly to the pile of blanks on the conveyor including the mass of the roller is in the range of about 1.2 to 2.5 pounds per linear inch of the width of the blank transverse to its direction of travel.

OPERATION OF SHINGLING APPARATUS

In operation of apparatus 20, as each blank is cut from the web by the rotating dies, it passes over the guide plate 74 and enters the accelerating mechanism 38. The accelerating mechanism increases the linear speed of each cut blank which produces a gap 94 between adjacent blanks. This gap permits each blank to be subsequently displaced and decelerated without being struck by an immediately succeeding blank and thereby becoming jammed or otherwise fouling up the operation of the apparatus.

As each blank emerges from the accelerating mechanism, its leading edge strikes the deflector plate 40 and the blank is deflected generally downwardly toward the carrier conveyor 42 as the blank advances along the plate.

Figure 4:
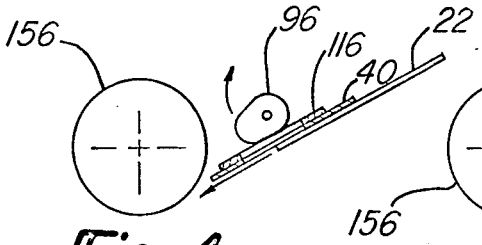
FIGS. 4–7 are semi-schematic views showing the timed relationship of the cam assembly to cut blanks passing through the apparatus of FIG. 1.
Figure 5:
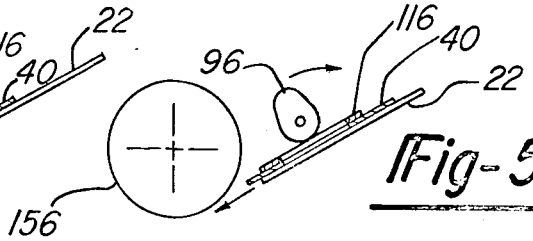
Figure 6:
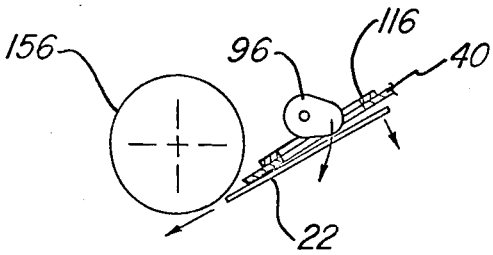
Figure 7:
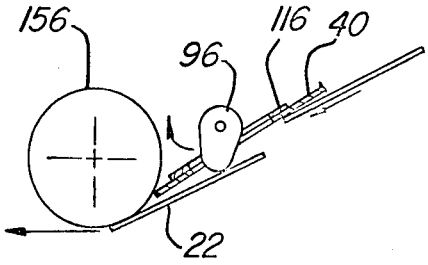

The drive mechanism rotates the cam assembly in synchronization with the cutting dies so the trailing portion of each blank is deflected by the cams 96 without interfering with movement of the leading portion of an immediately succeeding blank. As shown in FIG. 4, the leading edge of each blank passes under the rotating cams as they are positioned so that they do not interfere with advancement of the blank. As shown in FIG. 5, preferably the cams also do not displace the leading half of the blank as it advances under the cam assembly. As shown in FIGS. 6 and 7, as the trailing portion of each blank (usually the trailing $\frac{1}{3}$ or less) passes under the cams it is rapidly displaced by the cams from the inner face of the deflector plate. As shown in FIG. 1, after displacing the trailing portion of the blank the cams move out of the path of travel of the leading portion of the immediately succeeding blank so that it can pass under the cams without being displaced by them.

As each blank passes under the downstream edge of the deflector plate, it is rapidly decelerated by its leading edge striking the roller 156 and then as the blank is advanced by the conveyor, it passes under the roller. As shown in FIG. 1, when the blank is decelerated, its trailing edge has been displaced sufficiently by the cam so that the leading edge of an immediately succeeding blank can pass between the deflector plate 40 and the decelerated blank and into superimposed and overlapped relationship with the decelerated blank. The extent of the spacing 178 between the leading edges of adjacent blanks in the pile on the conveyor can be adjusted and controlled by varying and changing the speed of the conveyor relative to the speed of the accelerating mechanism. Increasing the relative speed of the conveyor increases the distance or spacing between the leading edges of the adjacent blanks and decreasing the relative speed decreases this spacing. The pile of shingled blanks can be transferred from the conveyor for further processing.

STACKING APPARATUS

Figure 12:
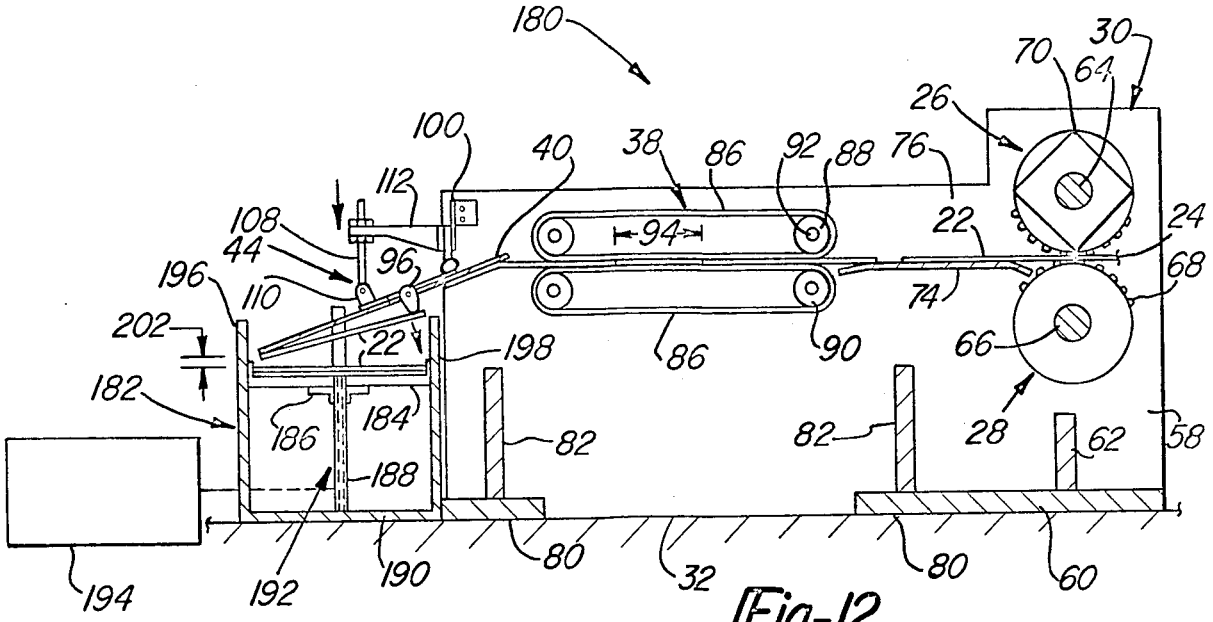
FIG. 12 is a side view with portions cut away and in section of an apparatus embodying this invention for piling a plurality of cut blanks in stacked relationship.
Figure 13:
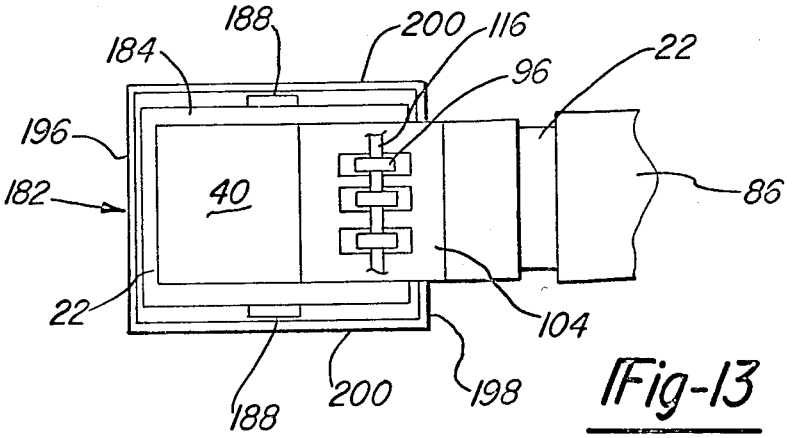
FIG. 13 is an enlarged and fragmentary top view of the apparatus of FIG. 12.

FIGS. 12 and 13 illustrate a modified apparatus 180 for piling a plurality of blanks cut by the rotating dies in a vertical stack. With this apparatus as each blank 22 emerges from the cutting dies 26, 28, it passes over the guide plate 74 and enters the accelerator mechanism 38 which increases the speed of the blank to provide a gap 94 between the blank and an immediately succeeding blank. As each blank emerges from the accelerator mechanism it engages the deflector plate 40 and is moved generally downwardly into a carrier mechanism 182. The trailing portion of each blank is rapidly deflected downwardly by the cam assembly 44 so that an immediately succeeding blank can pass over the preceding blank.

The carrier mechanism 182 has a platform 184 on which the blanks are received. The platform is secured to an elevator 186 received on upstanding guideways 188 fixed to a base 190. The elevator is raised and lowered by a drive 192 cycled and controlled by a programmable controller 194. The platform is enclosed and shielded by end walls 196, 198 and side walls 200 fixed to each other and the base. The end wall 196 provides a positive stop for decelerating each blank when it strikes the wall.

In operation of the stacking apparatus 180, the accelerator mechanism 38, deflector plate 40, and cam assembly 44 function and operate in the same manner as they do in apparatus 20. As each blank passes under the deflector plate, it is guided into the upper end of the carrier mechanism 182 and its forward movement is completely stopped when its leading edge strikes the end wall 196 of the mechanism. This results in the blank being deposited on the platform 184 in overlying and vertically stacked relationship with an immediately underlying blank. While the blanks are being deposited on the platform, it is lowered by the elevator 186 so that the blanks will be deposited in a vertical stack. The controller 194 actuates the drive 192 to lower the elevator at a rate corresponding the rate at which the blanks are deposited in the receiving mechanism so that the vertical space or clearance 202 remains substantially constant between the downstream edge of the deflector plate and the uppermost blank deposited on the platfrm. Preferably this clearance is only about 2 to 5 times greater than the thickness of one blank. Since the function and operation of the stacking apparatus 180 is otherwise very similar to that of the shingling apparatus 20, it will be apparent to skilled persons and hence not described in further detail.

We claim:

1. A method of piling a plurality of blanks of a flexible material comprising, completely severing a plurality of flexible blanks from a continuous web of a flexible material so that the cut blanks move substantially consecutively at a first speed of at least 300 lineal feet per minute, accelerating each cut blank along a first path of travel to a second speed at least 1.5 times said first speed to provide a gap between its trailing edge and the leading edge of an immediately succeeding cut blank, after acceleration of each blank positively deflecting each blank out of the first path of travel of such blank and onto a second path of travel inclined downwardly and at an acute included angle relative to said first path of travel, independently of said deflecting rapidly positively displacing the trailing edge of each blank from the second path of travel, and after deflection onto the second path of travel and out of the first path of travel rapidly decelerating each blank to a third speed of less than about 1/5 of the second speed of such blank and into a third position inclined at an acute included angle to said second path so that an immediately succeeding blank will overlap and at least in part be deposited upon such blank without sliding engagement therewith over a substantial length thereof to provide a pile of a plurality of overlapped cut blanks.

2. The process of claim 1 which also comprises, after decelerating each blank to such third speed, the step of continuing to move such blank so that after being deposited in the pile the leading edge of such blank is spaced from the leading edge of an immediately adjacent blank so that the blanks of the pile have a shingled relationship.

3. The process of claim 1 which also comprises rapidly decelerating each blank to a third speed of substantially zero so that the leading edges of the blanks in the pile are substantially aligned with each other so the blanks are in a stacked relationship.

4. The process of claim 1 wherein the blanks are severed from the web of material so that the blanks have substantially the same longitudinal length between their leading and trailing edges.

5. The process of claim 1 wherein the second speed is about 1.5 to 2.0 times the first speed.

6. The process of claim 2 wherein the decelerated blanks are received on and carried by a conveyor moving at a speed of less than 1/10 of the second speed.

7. The process of claim 6 wherein each blank is rapidly decelerated by contact with a retarder overlying the conveyor, defining in coperation with the conveyor a generally tapered entrance into which the leading edge each blank passes, and constructed and arranged so that each blank passes between the retarder and the conveyor.

8. The process of claim 7 wherein the retarder also comprises a contactor constructed and arranged to extend generally transversely across and bear on a blank and a fluid actuated ram constructed and arranged to yieldably urge the contactor toward the conveyor and into engagement with a blank underlying the contactor so that the force applied to the blanks by the retarder can be varied and adjusted within predetermined limits by varying the pressure of a fluid supplied to the ram.

9. The process of claim 1 wherein said first speed is at least 1,000 lineal feet per minute and the trailing edge of each blank is rapidly displaced from the second path of travel by at least one rotating cam which after displacing the trailing edge of one blank rotates to a position wherein it does not displace the leading edge of an immediately succeeding blank.

10. The process of claim 1 wherein the leading edge of each blank is deflected by a plate intersecting the first path of travel of the accelerated blanks and extending across and generally downstream of the first path of travel of the accelerated blanks.

11. The process of claim 10 wherein said first speed is at least 1,000 lineal feet per minute and the trailing portion of each blank is rapidly displaced from the second path of travel by at least one rotating cam which after displacing the trailing portion of each blank rotates to a position wherein it does not displace the leading edge of an immediately succeeding blank.

12. An apparatus for piling a plurality of blanks of a flexible material comprising, a rotary cutting die completely severing a plurality of flexible blanks from a continuous web of a flexible material so that the cut blanks move substantially consecutively at a first speed of at least 300 lineal feet per minute, an accelerating mechanism increasing the speed of each cut blank along a first predetermined path of travel to a second speed at least 1.5 times said first speed to produce a gap between its trailing edge and the leading edge of an immediately succeeding cut blank, a deflector constructed and arranged to positively deflect each blank, after it has been accelerated, out of the first path of travel of such blank and into a second path of travel inclined downwardly and at an acute included angle relative to said first path of travel, displacement means independent of said deflector and radpidly positively displacing the trailing portion of each blank from the second path of travel, and a retarder constructed and arranged to rapidly decelerate each blank to a third speed less than about 1/5 of said second path of travel and out of such first path of travel so that an immediately succeeding blank will overlap and at least in part be deposited upon such blank without sliding engagment therewith over a substantial length thereof and in a third position inclined at an acute included angle to said second path to provide pile of a plurality of overlapped and cut blanks. be deposited upon such blank to provide pile of a plurality of overlapped and cut blanks.

13. The apparatus of claim 12 wherein the cutting die severs the blanks from the web of material so that the cut blanks have substantially the same longitudinal length between their leading and trailing edges.

14. The apparatus of claim 12 wherein the first speed is at least 1,000 lineal feet per minute and the second speed is about 1.5 to 2.0 times the first speed.

15. The process of claim 12 which also comprises a carrier constructed and arranged to receive a pile of the blanks and said retarder decelerating each blank to a third speed of substantially zero so that the blanks are deposited on the carrier with their leading edges substantially aligned so the blanks are in stacked relationship on the carrier.

16. The apparatus of claim 12 which also comprises a conveyor constructed and arranged to receive the blanks and after deceleration of each blank to continue to move such blank so that after being deposited in the pile the leading edge of such blank is spaced from the leading edge of an immediately adjacent blank so the blanks of the pile have a shingled relationship.

17. The apparatus of claim 16 wherein the deposited blanks are received on and carried by the conveyor at a speed of less than 1/10 of the second speed.

18. The apparatus of claim 16 wherein the retarder has a contactor overlying the conveyor, defining in cooperation with the conveyor a generally tapered entrance into which the leading edge of each blank passes, and is constructed and arranged so that each blank passes between the contactor and the conveyor.

19. The apparatus of claim 18 wherein the retarder also comprises a fluid actuated cam constructed and arranged to yieldably urge the contactor toward the conveyor and into engagement with a blank underlying the contactor so that the force applied to the blanks by the retarder can be varied and adjusted within predetermined limits by varying the pressure of a fluid supplied to the ram.

20. The apparatus of claim 16 wherein the deflector comprises a plate intersecting the first path of travel of the accelerated blanks and extending across and generally downstream of the first path of travel of the accelerated blanks.

21. The apparatus of claim 16 wherein the displacement means comprises at least one rotating cam which displaces the trailing portion of each blank and then rotates to a position wherein it does not displace the leading edge of an immediately succeeding blank.

22. The apparatus of claim 12 wherein the displacement means comprises at least one rotating cam which displaces the trailing portion of one blank and then rotates to a position wherein it does not displace the leading edge of an immediately succeeding blank.

23. The method of claim 1 wherein the first speed is at least 1,000 lineal feet per minute.

24. The method of claim 1 wherein when each blank is severed it also has at least one of a cutout, tab, perforation, slit and crease therein.

25. The apparatus of claim 12 wherein the first speed is at least 1,000 lineal feet per minute.

26. The apparatus of claim 12 wherein when each blank is severed it also has at least one of a cutout, tab, perforation, slit and crease therein.

* * * * *

UNITED STATES PATENT AND TRADEMARK OFFICE

CERTIFICATE OF CORRECTION

PATENT NO. : 4,727,784

DATED : March 1, 1988

INVENTOR(S) : Albert J. Sarka and Jerry L. Bell

It is certified that error appears in the above—identified patent and that said Letters Patent is hereby corrected as shown below:

Column 10, lines 17-19, delete

-- be deposited upon such blank to provide pile of a plurality of overlapped and cut blanks. --

Signed and Sealed this

Sixteenth Day of August, 1988

*Attest:*

*Attesting Officer*

DONALD J. QUIGG

*Commissioner of Patents and Trademarks*